US010775074B2

(12) United States Patent
Rainey et al.

(10) Patent No.: US 10,775,074 B2
(45) Date of Patent: Sep. 15, 2020

(54) SOUND ATTENUATING AIR HANDLER PANEL APPARATUS AND METHOD

(71) Applicant: Johnson Controls Technology Company, Milwaukee, WI (US)

(72) Inventors: Melanie H. Rainey, Portland, OR (US); David L. Lawson, Vancouver, WA (US); Carl J. Shell, York, PA (US); Chris C. Hord, Vancouver, WA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 15/784,899

(22) Filed: Oct. 16, 2017

(65) Prior Publication Data

US 2018/0038614 A1 Feb. 8, 2018

Related U.S. Application Data

(63) Continuation of application No. 12/028,799, filed on Feb. 9, 2008, now Pat. No. 9,791,166.

(Continued)

(51) Int. Cl.
*F24F 13/24* (2006.01)
*F24F 3/044* (2006.01)

(52) U.S. Cl.
CPC ..... *F24F 13/24* (2013.01); *F24F 3/0442* (2013.01); *F24F 2221/54* (2013.01)

(58) Field of Classification Search
CPC ..... F24F 13/24; F24F 2013/242; E04B 2001/849; E04B 2001/8438

(Continued)

(56) References Cited

U.S. PATENT DOCUMENTS 2,299,112 A * 10/1942 Schilling ..... F24F 13/24 181/224
2,386,502 A * 10/1945 Peik ..... B63B 3/68 181/296

(Continued)

FOREIGN PATENT DOCUMENTS

DE 2357205 A * 5/1975
FR 2624641 A1 * 6/1989 ..... F24F 13/075
GB 1586062 A1 * 3/1981

OTHER PUBLICATIONS

Eckel, DE2357205A English machine translation, May 28, 1975 (Year: 1975).*

(Continued)

*Primary Examiner* — Edelmira Bosques
*Assistant Examiner* — Phillip Decker
(74) *Attorney, Agent, or Firm* — Fletcher Yoder, P.C.

(57) ABSTRACT

Systems and methods are directed to an air handler that reduces noise without reducing the pressure of air supplied to a space below minimum levels. The air handler includes a plenum forming a passageway for air. The plenum has a return side, a supply side, a fan within the plenum having a suction side and a pressure side to move air through the plenum, and a conditioning apparatus in the plenum for conditioning air through the plenum. The air handler further includes a sound-attenuating panel having a first side and an opposed second side that extend at least partially across the plenum. The panel is configured and positioned to interact with the flow of air to attenuate sound. The fan provides a pressure boost to air flowing through the plenum to counteract a pressure drop resulting from interaction between the air, the panel, and the conditioning apparatus.

11 Claims, 7 Drawing Sheets

Related U.S. Application Data

(60) Provisional application No. 60/889,190, filed on Feb. 9, 2007.

(58) Field of Classification Search
USPC ..... 454/251, 906; 181/224
See application file for complete search history.

(56) References Cited

U.S. PATENT DOCUMENTS 2,916,101 A 12/1959 Naman
3,159,237 A 12/1964 Thomas
3,219,143 A * 11/1965 Bohanon ..... F24F 7/025 181/224
3,378,100 A 4/1968 Welty
3,748,997 A 7/1973 Dean, Jr. et al.
3,895,686 A * 7/1975 Savkar ..... F02K 1/827 181/224
4,146,999 A * 4/1979 Petrovec ..... E04B 1/86 181/191
4,266,602 A 5/1981 White et al.
4,316,522 A * 2/1982 Hirschorn ..... F04D 29/664 181/224
4,432,434 A 2/1984 Dean, Jr.
4,747,505 A 5/1988 Hansen
4,842,097 A * 6/1989 Woodward ..... E04B 1/86 181/286
5,223,008 A * 6/1993 Troxell ..... B01D 46/002 55/350.1
5,313,803 A 5/1994 Detzer
5,332,872 A * 7/1994 Ewanek ..... F04D 29/663 181/224
5,586,861 A 12/1996 Berger
5,625,172 A * 4/1997 Blichmann ..... F02B 77/13 181/204
5,728,979 A 3/1998 Yazici et al.
5,787,651 A * 8/1998 Horn ..... E04B 2/7412 52/144
5,800,583 A * 9/1998 Pippel ..... B01D 46/10 55/467
6,273,213 B1 * 8/2001 Callas ..... G10K 11/16 181/200
6,342,005 B1 1/2002 Daniels et al.
6,345,688 B1 2/2002 Veen et al.
6,363,674 B1 * 4/2002 Carver ..... E04B 1/14 52/270
6,419,576 B1 7/2002 Han
6,945,355 B2 9/2005 Ludwig et al.
7,721,847 B2 * 5/2010 Coury ..... E04B 9/001 181/293
2001/0011007 A1 8/2001 Akhtar et al.
2003/0199245 A1 10/2003 Akhtar
2005/0118398 A1 * 6/2005 Reichwein ..... B32B 21/06 428/167
2005/0133302 A1 * 6/2005 Pfaffelhuber ..... B60R 13/08 181/293
2005/0247194 A1 * 11/2005 Kang ..... B01D 46/0086 95/19
2007/0207305 A1 * 9/2007 Hord ..... B32B 7/02 428/304.4
2008/0099274 A1 * 5/2008 Seel ..... H02K 5/24 181/202
2015/0267404 A1 * 9/2015 Yau ..... E04C 2/523 52/794.1

OTHER PUBLICATIONS

Barina, et al., "Speaker Mounting Bracket with Acoustic and Airflow Control Baffles," Dec. 1, 1992, IP.com, IBM Technical Disclosure Bulletin, vol. 35, No. 7, pp. 368-369. (Year: 1992).*

* cited by examiner

SOUND ATTENUATING AIR HANDLER PANEL APPARATUS AND METHOD

CROSS REFERENCE TO RELATED PATENT APPLICATIONS

This application is a continuation of U.S. patent application Ser. No. 12/028,799, entitled "AIR HANDLER PANELS," filed Feb. 9, 2008, which claims the benefit of U.S. Provisional Application No. 60/889,190, filed Feb. 9, 2007, which are hereby incorporated by reference in their entireties.

BACKGROUND

The application relates generally to sound reduction in an air handler for a heating, ventilating, air conditioning and refrigeration (HVAC&R) systems. The application relates more specifically to a panel in an air handler that attenuates sound.

Air handlers are used to supply large volumes conditioned air to an enclosed space, such as living spaces or work spaces in commercial environments. The large volumes of conditioned air, much of which may be recycled, are supplied and removed with large air movers, such as fans within the air handler. Further, the conditioned air must be supplied to the enclosed space by the air handler at a minimum pressure. One of the problems encountered with such air handlers is the generation of undesirable or excessive noise. Various schemes have been used to reduce the noise from air handlers including the addition of components to reduce noise that increase the size and complexity of the air handler, but which reduce the efficiency of the air handler due to associated reductions in pressure.

HVAC&R systems include at least one of a heating source and a cooling source in heat exchange communication with an air handler and an air distribution system. Heat exchange communication means that fluid from the heating source or the cooling source can exchange heat with air flowing in the air handler by either heating or cooling the air, without mixing with the air flowing in the air handler. The air distribution system includes a series of inlets, such as vents, and outlets, such as diffusers or terminals, connected to ducts that remove air from enclosed space of the building and returns the air to the enclosed space of the building, the air distribution system being in fluid communication with the air handler. The enclosed space of the building may be subdivided into a series of zones, rooms offices or combinations thereof that comprise the building space, each in fluid communication with the air distribution system through the vents, terminals or diffusers connected to the ducts in fluid communication with each of the zones, rooms or offices. As used herein, the enclosed space of the building, or simply building space, refers to the living or workspace within a building that comprises the building environment, which is subdivided into zones. The air distribution system provides air from the building space to the air handler where the air may be conditioned prior to being returned to the building space. While the air distribution system is in direct fluid communication with the building space to remove air (return air) and provide air (supply air) to the building space, the air handler may be located outside of the conditioned area. The air handler may be centrally located within the building space or remotely located outside of the building space. The air handler includes at least one conditioning apparatus in the plenum for conditioning air passing through the plenum, usually a coil for cooling and heating.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

The air handler can provide for proper conditioning of air supplied to the air distribution system and to the building space. The proper conditioning of the air can include at least one of heating, cooling, humidifying, dehumidifying, filtering and mixing return air with fresh air. The air handler includes a plenum, at least one fan located in the plenum and a heat exchanger located in the plenum, the fan moving the air through the plenum and across the heat exchanger, the plenum forming a passageway for the air. The plenum may be of any cross-sectional configuration, for example, square, round, circular, oval. The fan has a pressure side and a suction side and divides the plenum into a return side (suction side) and a supply side (pressure side) corresponding to a return duct and a supply duct of the air distribution system.

Because the air distribution system is physically connected to the air handler, sound generated in the air handler is generally transmitted along or through the plenum to the air distribution system and then to the building space. Sound can be generated by fan(s) associated with the air handler, the heat exchanger, which can include heating or cooling coils, air filters, humidification or dehumidification equipment, or the airflow along the plenum of the air handler and the walls or boundaries of the air distribution system. The air handler can include a sound-attenuating panel or wall that provides for noise reduction due to these sources, without reducing the pressure of conditioned air below minimum levels. The sound attenuating panel or wall can be included in original equipment or can be retrofitted into an existing air handler. The air handler comprises a plenum, the plenum forming a passageway for air. The plenum includes a return side, in fluid communication with a return duct of the air handler system, and a supply side, in fluid communication with a supply duct of the air handler system. A fan is positioned in the plenum of the air handler, the fan having a suction side to draw air from a building space, through the return duct and into the return side of the plenum, and a pressure side to move air out of the supply side of the plenum, through the supply duct and back into the building space. The plenum further includes at least one sound-attenuating panel, which also may be referred to as an acoustic panel or wall, the sound-attenuating panel having a first side and an opposed second side. In one embodiment, the plenum includes a plurality of panels. The panel is positioned in the plenum so that the panel extends at least partially across the plenum in the air passageway and is attached to the plenum by any suitable technique so that movement or vibration of the panel is limited, and if possible, eliminated. The panel is arranged to interact with the flow of air in the plenum, while permitting air flow through the plenum. The interaction between the sound-attenuating panel and the air results in sound absorption. When a plurality of panels are utilized, the panels are arranged in relation to one another so that air passing through the openings cannot traverse the plenum passageway unimpeded or unobstructed, that is, there is no straight line air flow path through the plenum that does not contact a panel or portion of a panel. The interaction of the air with a sound-attenuating panel or wall in the plenum can result in a pressure drop, but the fan can be selected to provide a pressure boost to the air flowing through the plenum to counteract the pressure drop of air passing through the sound-attenuating panels as well as any pressure drop resulting from the interaction of the air with any of the conditioning apparatus positioned in the air handler.

A plurality of panels may form a single row across the plenum, the panels being discontinuous from one another so that air can pass between them. The panels may also form a plurality of rows across the plenum, the panels in one row being arranged in a staggered configuration with the panels in an adjacent row. While attenuating sound by absorption or reflection, the panels can impede the flow of air through the plenum, thereby reducing the pressure of the air supplied to the air distribution system. Thus, the spacing of adjacent panels in a row of panels as well as the number of rows of panels added to the air handler is limited by the corresponding pressure drop of the air flowing through the panels.

The panels providing noise reduction are attached to a boundary of the plenum and extend outward into the passageway. The panels can be attached by any suitable technique. The panels may be located on the supply side or the return side of the plenum.

An advantage of the sound-attenuating panels is that they can be provided as a feature of a new air handler, or they can be retrofitted in an existing air handler because of the simplicity of their design.

A retrofit of an existing air handler with the sound-attenuating panels can include an upgrade of the existing fan in the air handler with a new fan to provide air of higher pressure, if the addition of the noise reduction panels results in an unacceptable pressure drop in the supply air.

Another advantage is that the retrofit of an existing air handler with these sound-attenuating panels can be accomplished at a lower cost, as compared to the cost of installing a new air handler, as the panels and their installation are relatively inexpensive.

Alternative exemplary embodiments relate to other features and combinations of features as may be generally recited in the claims.

DETAILED DESCRIPTION OF THE EXEMPLARY EMBODIMENTS

Figure 1:
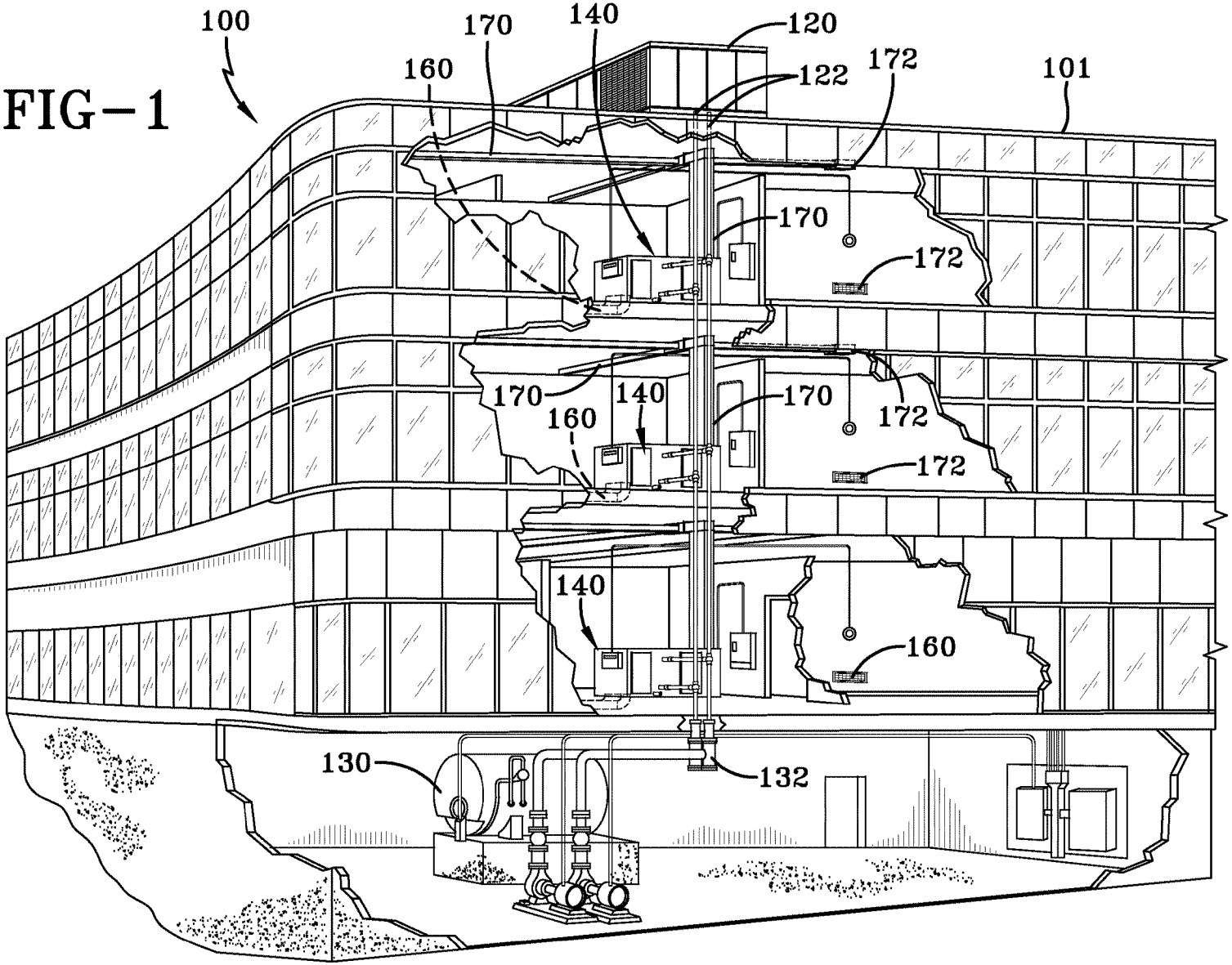
FIG. 1 depicts a cutaway view of a building that is equipped with HVAC&R system.
Figure 2:
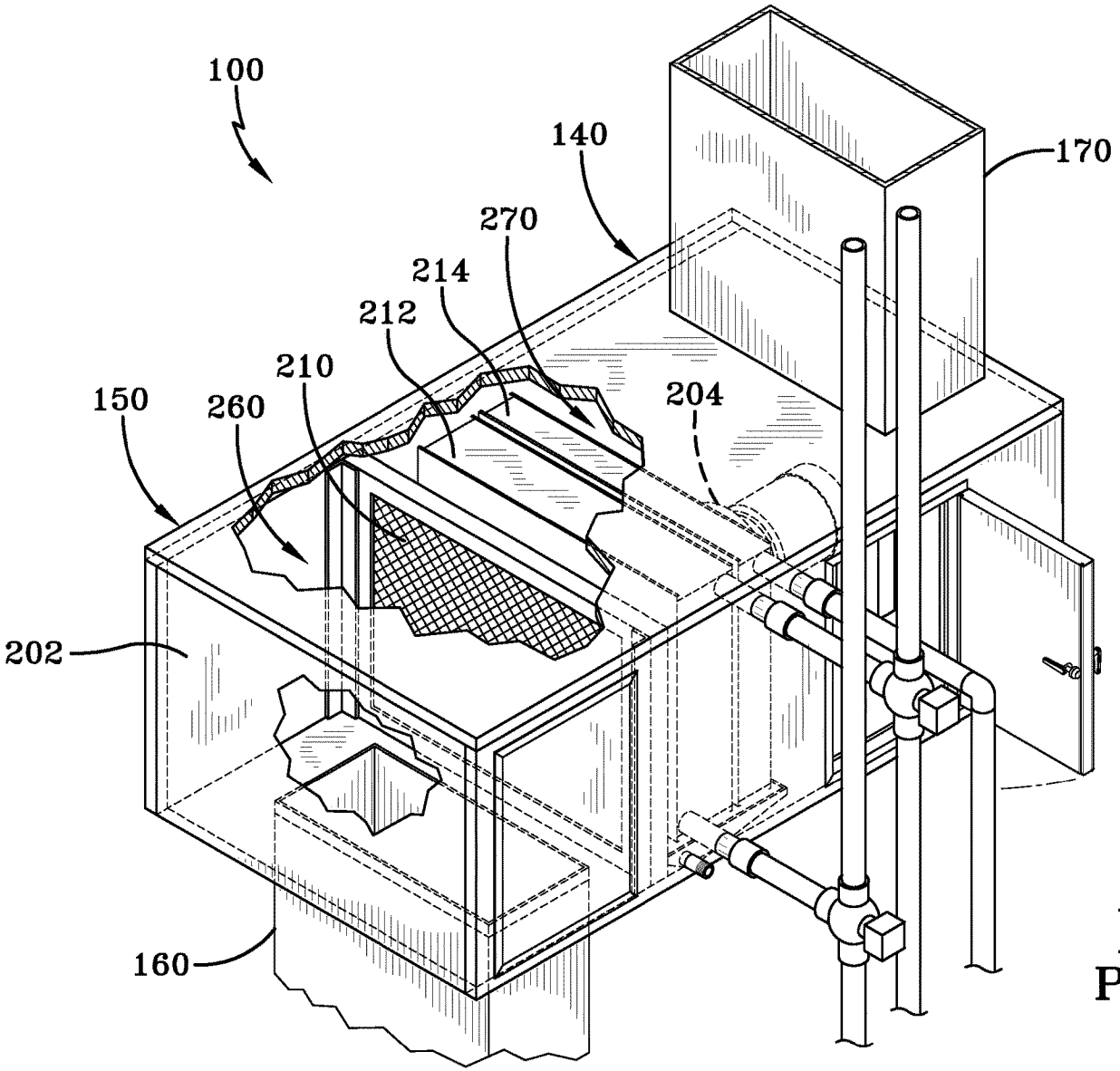
FIG-2 Prior Art
FIG. 2 depicts an air handler having connections to the refrigeration and heating equipment in fluid communication with the supply and return ducts.

FIG. 1 shows an exemplary HVAC&R system 100 for a building 101 in a typical commercial setting. The system 100 includes a rooftop chiller 120 to supply a chilled liquid, a boiler 130 located in the basement to supply a heated liquid, an air return duct 160, an air supply duct 170 and an air handler 140. Referring to FIG. 2, air handler 140 further includes a plenum 202 housing, in series, a fan 204, sometimes referred to as a blower, and a heat exchanger 150. Heat exchanger 150 can be in fluid communication with chiller 120 by conduits 122 and boiler 130 by conduits 132 to provide heating or cooling. System 100 is shown with a separate air handler on each floor of building 101, but it will be appreciated that these components may be shared between or among floors. For example, in an alternative embodiment, system 100 includes only one air handler 140 in fluid communication with the air distribution system that provides conditioned air to building 101. Chiller 120 supplies chilled liquid, such as cooled water, to air handler 140 by piping the chilled liquid to heat exchanger 150, while boiler 130 provides heated liquid, such as heated water, to air handler 140 by piping the heated coolant to heat exchanger 150. The heat exchanger may utilize a single coil for both cooling or heating by controlling the source of liquid to heat exchanger 150 by valves, which control the flow of liquid to heat exchanger 150 from either chiller 120 or boiler 130 depending upon whether there is a heating demand or a cooling demand. Alternatively, the heat exchanger may have separate coils, one dedicated to heating and in fluid communication with the boiler, and one dedicated to cooling and in fluid communication with the chiller, may be included in air handler 140, each being operational depending upon either a heating demand or a cooling demand. System 100 may include other features that are not shown and/or described in FIGS. 1 and 2.

Return duct 160 may include an outside opening that allows outside air to enter the return duct 160, thereby permitting fresh air to be mixed with return air, conditioned and circulated as supply air within building 101. Air handler 140 draws return air from the building through return duct 160. When so equipped, fresh air may also be drawn into the return duct through the outside opening. Air handler 140 then draws the return air through its heat exchanger 150, so that the air is cooled or heated as it passes over and through heat exchanger coil 212.

Figure 3:
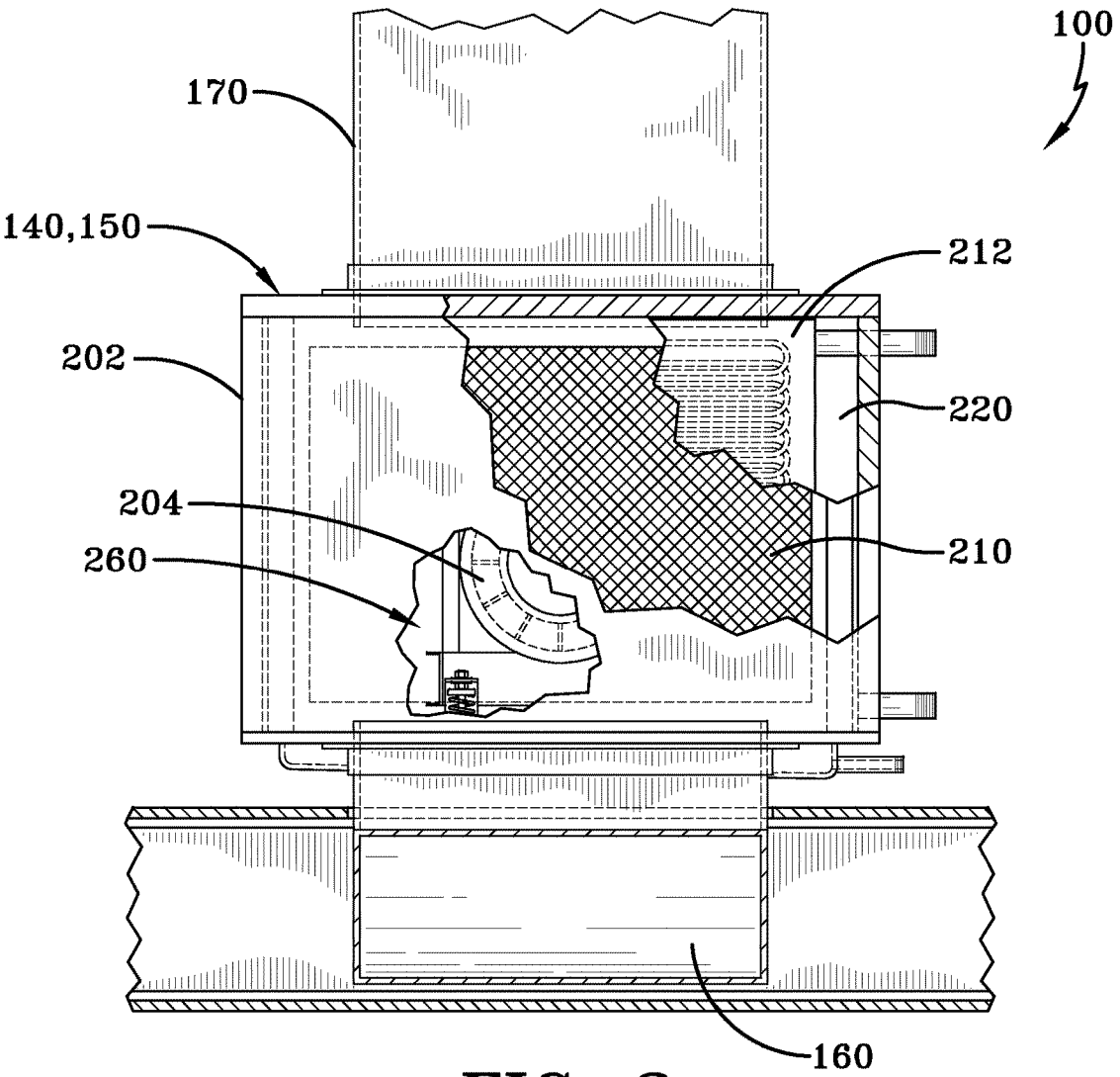
FIG-3 Prior Art
FIG. 3 depicts a side view of the air handler of FIG. 2.
Figure 4:
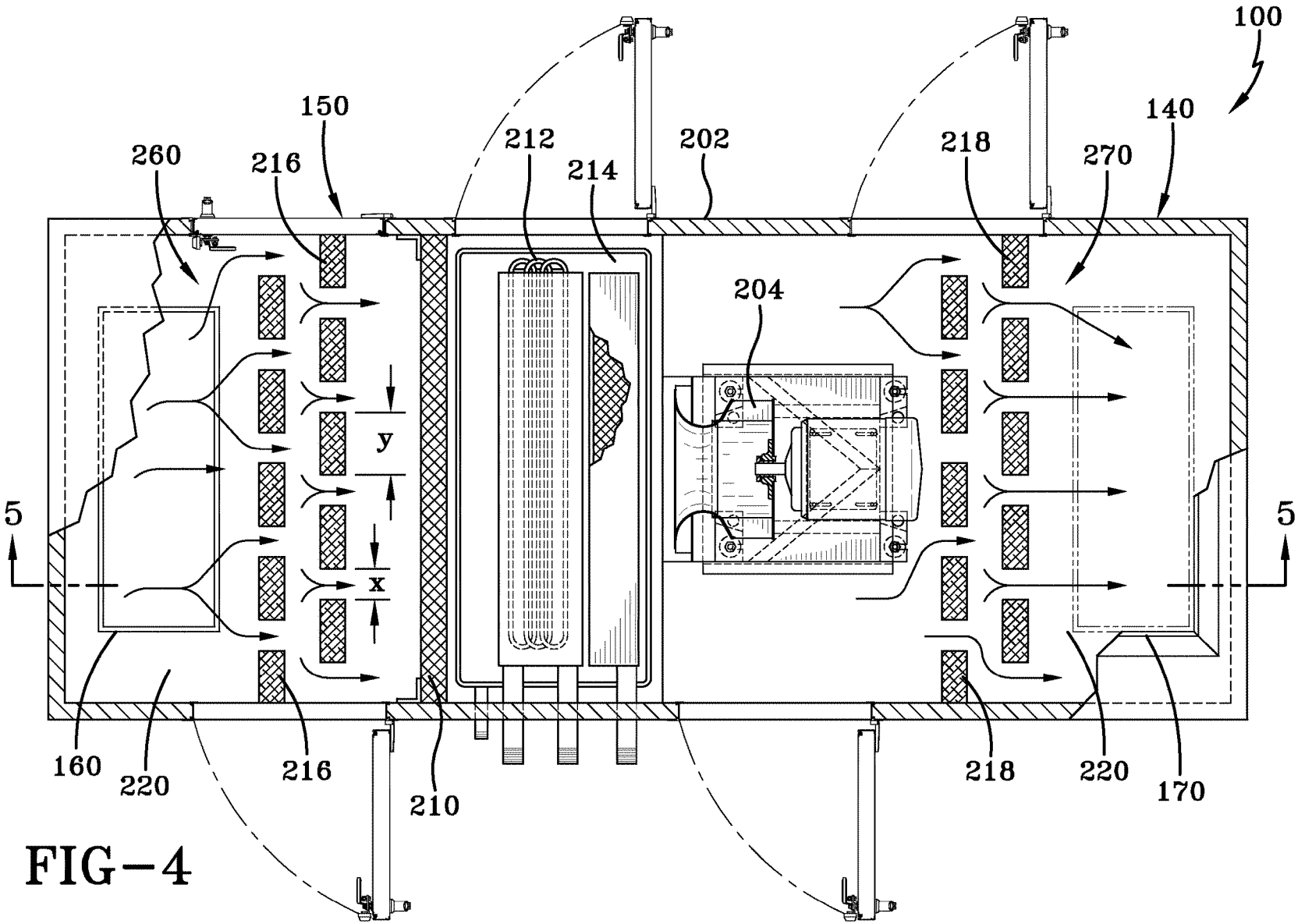
FIG. 4 is a top view of an air handler that includes rows of sound attenuating walls projecting into the plenum passageway.
Figure 5:
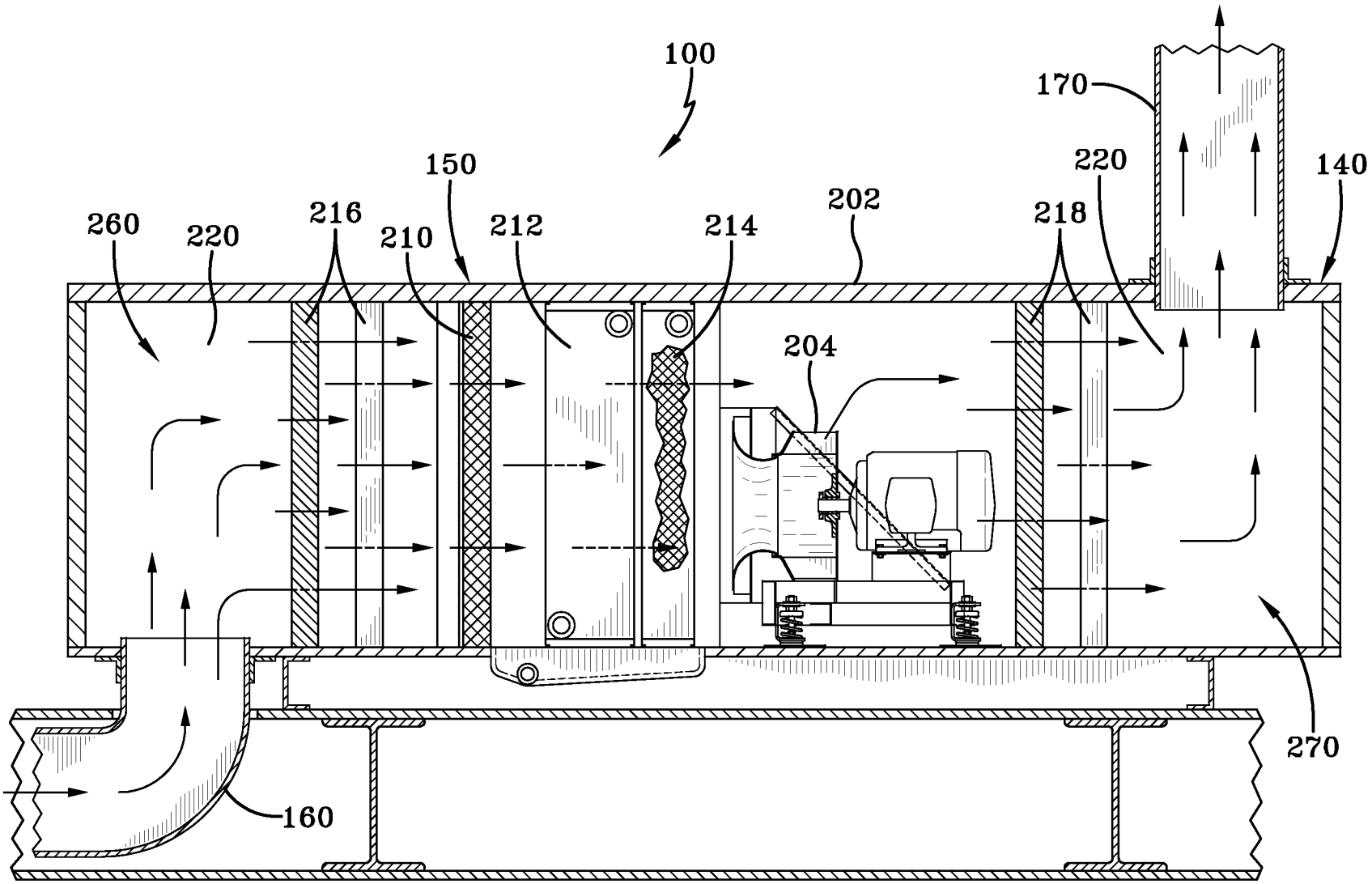
FIG. 5 is a side view of the air handler of FIG. 4.

Referring now to FIGS. 4 and 5, air handler 140 includes heat exchanger 150 which includes a heat exchanger coil 212, and may also include an optional air filter 210 and an air humidifier 214, which are also included in FIG. 2. Air handler 140 may also utilize coil 212 in heat exchanger 150 to dehumidify the air. Filter 210, coil 212 and humidifier 214 are depicted in FIG. 4, but are not shown in FIGS. 2 and 3. It will be understood that filter 210 and humidifier 214 may be included in the assembly of FIGS. 2 and 3, as desired. The conditioned air passing through air handler 140 is then discharged through discharge duct 170 for distribution in building 101.

Air handler 140 includes a fan 204 or blower that draws air from the building through return duct 160 and over coils 212 of heat exchanger 150 to cool or heat the air as required. Air handler 140 pressurizes the air with fan 204, which then forces air through supply duct 170 for distribution in building 101. Air handler 140 is shown in FIGS. 2-6 with fan 204, but in alternative embodiments, air handler 140 may include two or more fans 204 to increase flow and pressure, evenly distribute flow, and/or to provide system redundancy.

Sound may be transmitted through an air handler as a result of the noise produced by equipment associated with the air handler as well as air moving through the air handler. The air itself is a fluid that moves through the system. Sound propagated in the form of waves of different frequencies is transmitted to the building space through the air. The sound may be transmitted along plenum 202 as well as along material forming the air distribution ducts. As depicted in FIGS. 4 and 5, walls 216, 218 project from the sides of air plenum 202 into air plenum passageway 220. Walls 216, 218 may reduce the sound transmitted along the plenum of the air handler through which the air moves because their projection into passageway 220 affects the sound waves propagated with the air in plenum passageway.

Figure 6:
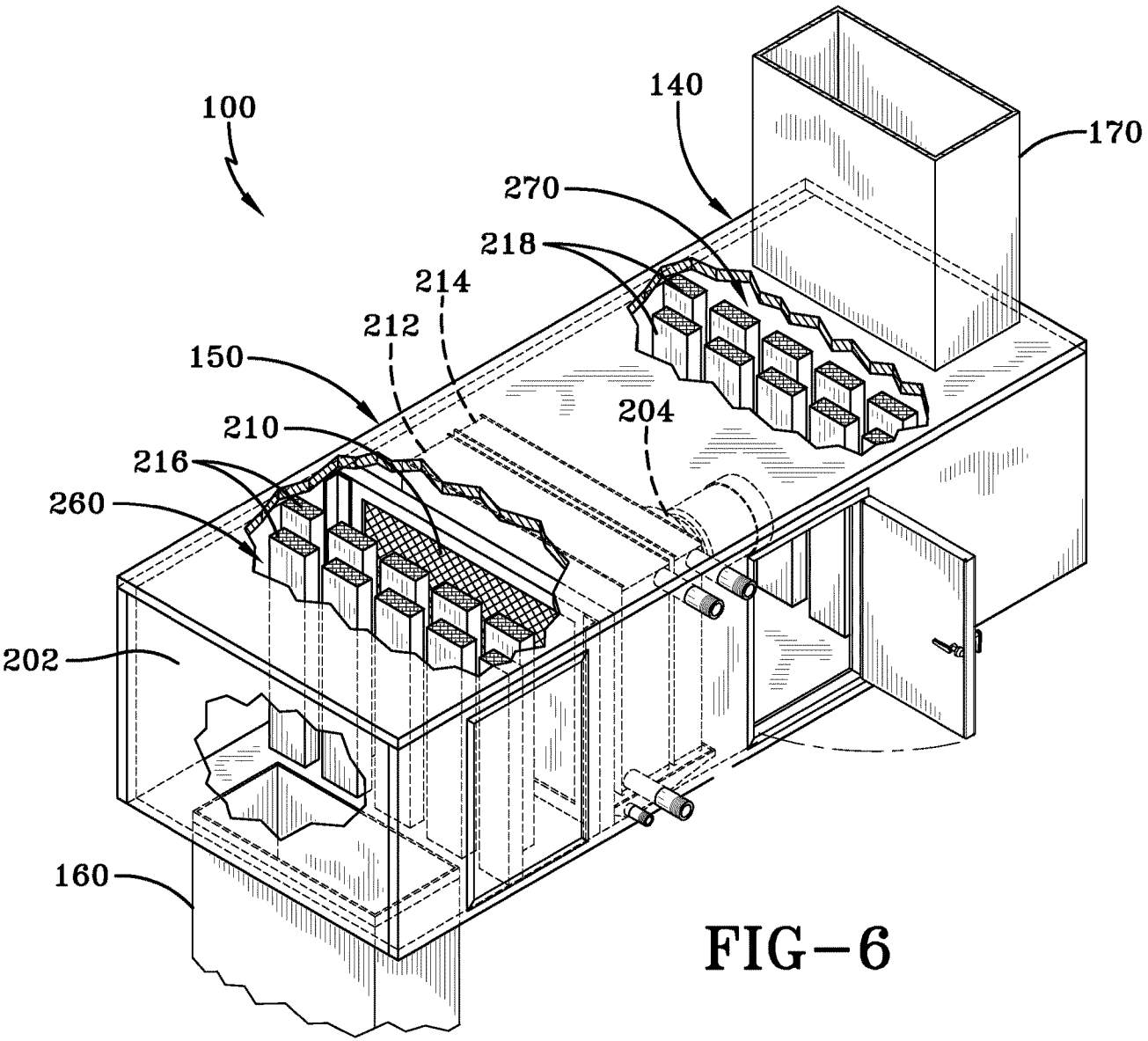
FIG. 6 is an isometric view of the air handler of FIG. 4.

FIG. 4 depicts a top view of an air handler 140 (with the top wall removed and access doors open) that further includes rows of walls 216, 218 or panels projecting into passageway 220 on both a return side 260 and a supply side 270 of plenum 202, while FIG. 5 depicts a side view of air handler 140. FIG. 6 is an isometric view of the air handler of FIGS. 4 and 5, but with only one access door open. Fan 204 is positioned in plenum 202. Fan operation draws air in from the air distribution system through return duct 160 on the return side of the air distribution system, which is located on the suction side of the fan. The air is conditioned by passing through heat exchanger 150 and over or past optional filter 210, coils 212 and optional humidifier 214. Heat exchanger 150 may provide heating or cooling, depending upon the demands of the building space. Air handler 140 having plenum 202 is connected to a supply duct 170 on supply side 270 of plenum 202 and, on return side 260 of the plenum 202, to a return duct 160 which may include an exhaust duct (not shown) to exhaust a portion of return air from the building space and a fresh air duct (not shown) to replace exhausted air with fresh air from outside the building. Heat exchanger 150 operating in the cooling mode may also provide dehumidification. The conditioned air exits air handler plenum 202 through supply duct 170 on the pressure side of the fan where it is returned to the building space.

A plurality of sound-attenuating panels or walls 216, 218 are located in plenum 202. Walls 216 or panels are located on the return 260 or suction side 260 of plenum 202, while walls 218 or panels are located on the pressure or supply side 270 of plenum 202. Panels or walls 216, 218 are arranged in a plurality of rows. Each row includes a plurality of discrete panels or walls, the panels being substantially coplanar and separated by a gap from adjacent panels by a preselected distance "x". The width of each panel or wall is a preselected width "y". A plurality of rows are provided, each row being substantially parallel to an adjacent row, the panels in adjacent rows being staggered with respect to one another. While "x" and "y" can be any width or distance, the relationship between "x" and "y" is such that "y" is greater than "x" (y>x). It is to be understood that "x" and "y" are variables, and in any one application, "x" can assume a range of values $x_1, x_2 \ldots x_n$, while "y" can assume a range of values $y_2 \ldots y_m$. The panels in adjacent rows are arranged in staggered formation so that the panels in a first row overlap the space between the panels of the adjacent row. Thus the width "y" of a panel in one row substantially overlaps the gap "x" between panels in an adjacent row. Such an arrangement is provided so that airflow is impeded by discrete panels or walls 216, 218 in plenum 202, that is, the air passing through plenum 202 impacts at least one panel as it traverses plenum 202. Although panels or walls 216, 218 are shown having widths "y" and gaps "x" that are substantially equal, as long as overlap occurs between panels or walls 216, 218 of one row with panels or walls 216, 218 of another row so that air cannot pass through the plenum unimpeded, the gaps "x" and widths "y" can vary.

FIG. 4 depicts two rows of panels or walls 216 on the suction side of fan 204 and two rows of panels or walls 218 on the pressure side of fan 204. In another embodiment, it is not necessary to have panels or walls on both the pressure side and the suction side of fan 204. In one embodiment, when panels or walls 218 are provided on only one side of fan 204, the panels or walls 218 should be located on the pressure side of fan 204. Sound waves traveling in the air through the plenum can be disrupted as they strike the panels. Panels 216, 218 will also cause a pressure drop in the air traversing through the plenum. The design of panels 216, 218 and the power of the fan are used to prevent undesirable pressure drop or air turbulence.

Figure 7B:
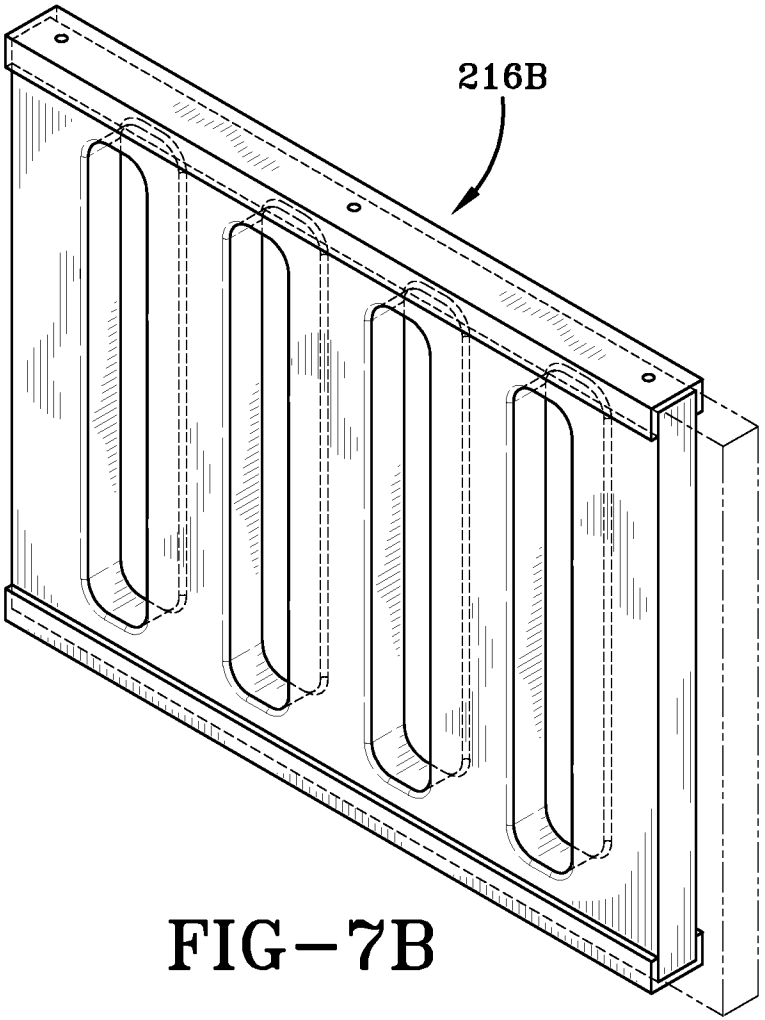
FIGS. 7A and 7B is a perspective views of different embodiments of the sound insulation panels installed in attachments.
Figure 7A:
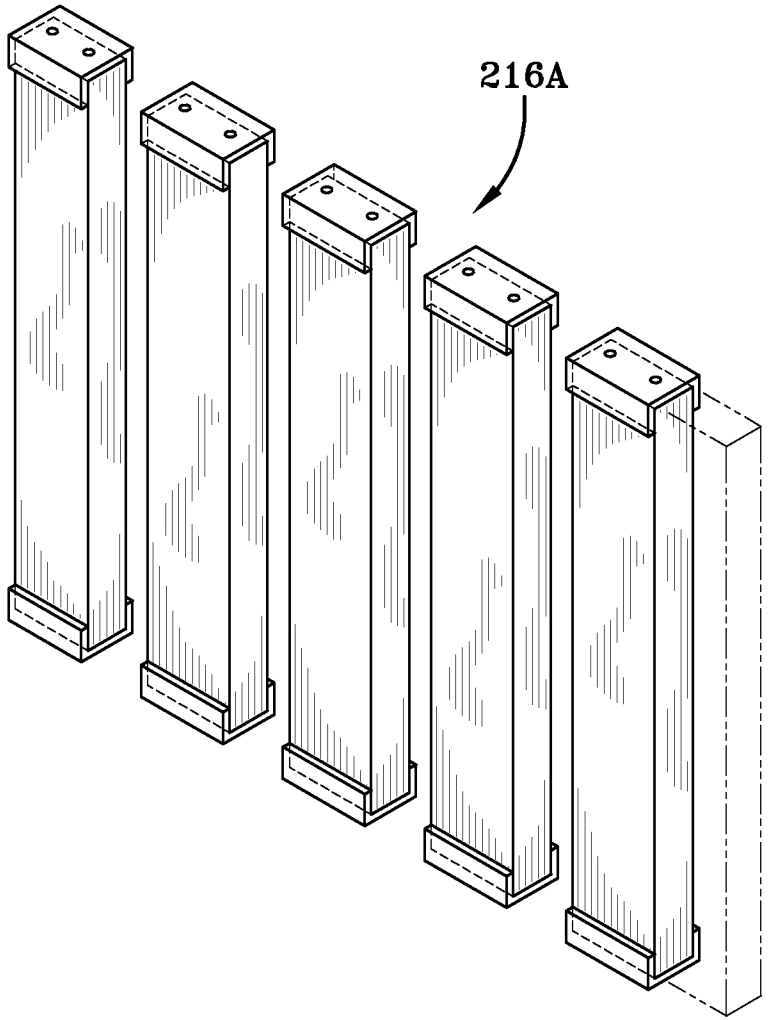

Air striking the panels or walls 216, 218 can disrupt sound waves being transmitted through or with the air. The panels or walls can also disrupt the flow of air, causing a pressure drop. Panels or walls 216, 218 are designed so that they do not generate significant noise as the air strikes them. For discharge applications, the noise on the pressure side of the fan downstream of panels or walls 218 must be less than the noise upstream of panels or walls 218. As used herein, noise is sound that is loud, unpleasant and/or undesired. The usual frequency range of sound extends from about 20 hertz (Hz) to about 20,000 Hz. To avoid noise generation from vibration, panels or walls 216, 218 may extend completely across plenum 202, as shown in FIG. 7A, that is to say, at least a portion of two opposed edges of the panel are affixed to opposed walls or sides of plenum 202 to minimize vibrations and any noise from such vibrations. Considering that air desirably should not pass through plenum 202 unimpeded, a further embodiment includes, as shown in FIG. 7B a single panel with at least two edges of the panel affixed to two walls or sides of the plenum, the single panel having slots cut therein, the slots having a preselected size "x" partitioning the panel or wall into sections having a preselected width "y", the slots extending in a direction substantially perpendicular to "x" to form openings in the panel substantially perpendicular to the direction of air flow. These openings resemble "windows" in panel or wall 216, 218, with the air passing between the sections and through the windows. In one embodiment a plurality of panels or walls 216, 218 are arranged in a plurality of adjacent rows so that the openings in panels 216, 218 in adjacent rows are staggered with respect to one another so that air flow through plenum 202 is impeded as it flows through the openings.

Panels or walls 216, 218 can be manufactured from a sound-absorbing material or a sound reflecting material. The material may be of any type that can attenuate audible sound, and may be rigid, foam or fibrous, such as fiberglass, and may include variations and combinations of sound absorbing materials. The material may be a cellular type of material. In addition, the material may be solid or semisolid material. Panels or walls 216, 218 may extend from the plenum in a top-to-bottom arrangement, in a side-to-side arrangement or in any combination. The function of panels or walls 216, 218 is to break up any sound waves carried by the air or prevent transmission of unimpeded sound waves to supply duct 170, thereby attenuating sound. Sound attenuation is accomplished by any configuration that prevents a substantially unimpeded passage of air return duct 160 to the supply duct 170. Attenuation can be accomplished by sound absorption, sound reflection and combinations of reflection and absorption that alters the incident sound wave. Thus, panels or walls 216, 218 do not have to be coplanar with one another, as depicted in the embodiment of FIGS. 4 and 5, since other staggered configurations can also prevent the substantially unimpeded passage of air from return duct 160 to supply duct 170. In addition, panels or walls 216, 218 may be arranged in the plenum so that they are not coplanar with one another. While panels or walls a 216, 218 are shown installed perpendicular to the air flow in plenum 202, this is not meant to be a limitation and panels or walls 216, 218 can be installed in plenum 202 so as not to be perpendicular to the air flow. Furthermore, it is not necessary that the individual panels be rectangular or square, since panels having an arcuate-shaped profile can also be arranged to prevent the substantially unimpeded passage of air from return duct 160 to supply duct 170.

The panels or walls 216, 218 are installed in return side 260 of plenum 202 and supply side 270 of plenum 202, the opposed ends of the panels being supported by attachments to plenum 202 so that the panels or walls extend across plenum 202. While the attachment to the plenum may be any suitable device that limits movement or vibration of the panels or walls, in one embodiment, the attachments are simple U-channels on opposed edges or panels or walls 216A, 216B, as depicted in FIGS. 7A and 7B. In FIGS. 7A and 7B, the plenum walls to which the U-channels are assembled are not included. Plenum 202 of air handler 140 and ducts 160, 170 of the air distribution system are conduits that can be manufactured of any suitable material. Plenum 202 and ducts 160, 170 can be made of fiberglass material, to provide plenum 202 and ducts 160, 170 with sound attenuation properties. In another embodiment, in many building applications, plenums as well as ducts may be made from a sheet metal material such as aluminum or an alloy thereof, although other metals may be used. Sound may be readily conducted along the metal plenum and ducts. The assembly of the panels to plenum 202, which span plenum 202, can result in panels 216, 218 and their points of attachment acting as nodes that dampen the sound waves that also travel along metallic plenum 202 and ducts 160, 170. Thus, the panels or walls can beneficially attenuate sound conducted along the metallic plenum as well as sound being transmitted with the air through plenum 202.

Panels 216, 218 can be incorporated into the design of new air handlers. As part of the design, the pressure drop associated with the installation of a preselected number of panels or walls 216, 218 in a predetermined configuration with a predetermined number of rows (if appropriate) can be readily determined. A fan having the appropriate power requirements can be provided as part of the design to overcome any pressure drops associated with the insertion of the panels or walls 216, 218 in air handler 140. Air handler 140 can be installed as a replacement unit in an existing HVAC&R system or it may be part of a new HVAC&R system.

The sound attenuating panels can be appropriately placed along the plenum to achieve a desired sound reduction. A predetermined amount of sound reduction can be achieved by proper selection of panel material, panel location and number of panels. The design of the system can provide desired sound levels and frequencies. The adjustment and control of the noise levels that are transmitted by the air handler plenum can be varied by appropriate selection and location of panels. The control of noise levels is accomplished by varying not only the location of the panels, but also the number of the panels, the size of the panels, the spacing between the panels in a row, the spacing between adjacent rows of panels (or the size of windows in a single panel design), the number of rows of panels, the material comprising the panels, and/or the fan power.

Panels or walls 216, 218 can also be retrofitted into an existing system. Plenum 202 is readily accessible and attachments for opposed ends of panels or walls 216, 218 can be installed into plenum 202 on either return side 260 of plenum 202 or on supply side 270 of plenum 202. Panels or walls 216, 218 of the appropriate size and material can be installed spanning plenum 202. If, after installation, pressure drop of the system is determined to be excessive to so that the building space does not receive sufficient conditioned air, the existing fan 204 can be replaced with a fan having sufficient power to provide air with sufficient pressure to properly condition the building space.

The panels or walls 216, 218 may be installed to be readily removable, so that access to all of the components located in the plenum 202 is not impeded, so that repairs and maintenance can readily be accomplished by technicians, as required. Panels or walls 216, 218 can be located on both the pressure side of the plenum and the suction side of the plenum. Sound generated by operation of the HVAC&R equipment located in plenum is transmitted by waves traveling through air in the plenum at the speed of sound, which is much faster than the speed of the air traveling in the plenum. The sound can be transmitted into the air distribution system along both supply side ducts 270 and return side ducts 260, and once the sound is transmitted beyond air handler 140, the sound is conducted along these ducts. Nevertheless, the sound transmitted by air will not move as readily through return air as through supply air. For this reason, the sound attenuating panels can be located in the plenum on the suction side and the pressure side.

The sound insulation panels provide effective sound attenuation for an air handler 140. The sound attenuation equipment, in the form of panels or walls 216, 218 is flexible and can be used in new air handlers as well as a retrofit for existing air handlers. The sound attenuation panels or walls are used to break up sound waves carried by air in plenum 202 of the air handler 140 as well as along the plenum structure itself. The panels or walls are readily removable to provide access to technicians for maintenance or repair operations. The panels or walls within the air handler can be tuned by selection of size, location and number of panels to provide desired levels of sound attenuation. Air pressure drops resulting from adding panels or walls 216, 218 into plenum 202 can be overcome by providing a new, properly sized fan 204 in air handler 140 and by properly selecting panel or wall spacing.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the air handler having sound attenuating panels as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A system, comprising:

a plenum forming an air passageway, wherein the plenum comprises a return side in fluid communication with a return duct and a supply side in fluid communication with a supply duct;

a fan configured to direct a flow of air through the plenum in a first direction;

a heat exchanger disposed in the plenum, wherein the heat exchanger is configured to place the flow of air through the plenum in a heat exchange relationship with a working fluid;

a first plurality of sound attenuating panels aligned in a first row, wherein each sound attenuating panel of the first plurality of sound attenuating panels is positioned in the plenum so that each sound attenuating panel of the first plurality of sound attenuating panels extends at least partially across the plenum, wherein the first plurality of sound attenuating panels is configured and positioned to interact with the flow of air in the plenum so as to attenuate sound propagated through the plenum, and wherein each sound attenuating panel of the first plurality of sound attenuating panels is spaced a first distance from one another to form a first plurality of gaps;

a second plurality of sound attenuating panels aligned in a second row, wherein each sound attenuating panel of the second plurality of sound attenuating panels is positioned in the plenum so that each sound attenuating panel of the second plurality of sound attenuating panels extends at least partially across the plenum, wherein the second plurality of sound attenuating panels is configured and positioned to interact with the flow of air in the plenum so as to attenuate sound propagated through the plenum, wherein each sound attenuating panel of the second plurality of sound attenuating panels is spaced a second distance from one another to form a second plurality of gaps, and wherein the first plurality of gaps do not overlap with the second plurality of gaps with respect to a direction of the flow of air through the plenum;

a first plurality of channels coupled to a wall of the plenum and aligned with the first plurality of sound attenuating panels with respect to a second direction, crosswise to the first direction, wherein each channel of the first plurality of channels comprises a first top portion and a first bottom portion configured to receive and secure a single, respective sound attenuating panel of the first plurality of sound attenuating panels to the wall of the plenum to block movement and vibration of the first plurality of sound attenuating panels; and a second plurality of channels coupled to the wall of the plenum and aligned with the second plurality of sound attenuating panels with respect to the second direction, wherein each channel of the second plurality of channels comprises a second top portion and a second bottom portion configured to receive and secure a single, respective sound attenuating panel of the second plurality of sound attenuating panels to the wall of the plenum to block movement and vibration of the second plurality of sound attenuating panels.

2. The system of claim 1, wherein the first plurality of sound attenuating panels, or the second plurality of sound attenuating panels, or both, comprises a sound-absorbing material comprising foam, fiber, multidensity, or a combination thereof.

3. The system of claim 2, wherein the sound-absorbing material comprises fiberglass.

4. The system of claim 1, wherein the first plurality of sound attenuating panels, or the second plurality of sound attenuating panels, or both, is configured to attenuate sound propagated through the plenum across a frequency range of 20 Hertz (Hz) to 20,000 Hz.

5. The system of claim 1, wherein the first plurality of channels, the second plurality of channels, or both, is a plurality of U-channels.

6. The system of claim 1, wherein the fan provides a pressure boost to the flow of air through the plenum to counteract a pressure drop of the flow of air resulting from interaction between the flow of air and the first and second pluralities of sound attenuating panels in the plenum.

7. The system of claim 1, wherein each channel of the first plurality of channels has a first width that is the same as a second width of each sound attenuating panel of the first plurality of sound attenuating panels, and each channel of the second plurality of channels has a third width that is the same as a fourth width of each sound attenuating panel of the second plurality of sound attenuating panels.

8. A method, comprising:

directing a flow of air through a plenum of an air handler via a fan across a first sound attenuating panel having a first plurality of slots extending through the first sound attenuating panel with respect to a first direction of the flow of air through the plenum, wherein the first sound attenuating panel is positioned upstream of the fan with respect to the first direction of the flow of air through the plenum;

directing the flow of air through the plenum via the fan across a second sound attenuating panel having a second plurality of slots extending through the second sound attenuating panel with respect to the first direction of the flow of air through the plenum, wherein the second sound attenuating panel is positioned downstream of the fan with respect to the first direction of the flow of air through the plenum, wherein the second plurality of slots is positioned offset from the first plurality of slots with respect to a second direction crosswise to the first direction of the flow of air through the plenum, wherein the first and second sound attenuating panels are each coupled to a wall of the plenum via a respective channel, and wherein the first and second sound attenuating panels are each configured to interact with the flow of air in the plenum so as to attenuate sound propagated through the air handler; and adjusting a speed of the fan to provide a pressure boost to the flow of air through the plenum to counteract a pressure drop experienced by the flow of air through the plenum caused by the first and second sound attenuating panels.

9. The method of claim 8, comprising conditioning the flow of air by directing the flow of air over a heat exchanger disposed in the plenum, wherein the heat exchanger places the flow of air in a heat exchange relationship with a working fluid.

10. The method of claim 9, comprising:

filtering the flow of air by directing the flow of air through a filter disposed upstream of the heat exchanger with respect to the first direction of the flow of air through the plenum; and humidifying the flow of air by directing the flow of air through a humidifier disposed downstream of the heat exchanger with respect to the first direction of the flow of air through the plenum.

11. The method of claim 8, wherein the first and second sound attenuating panels are configured to attenuate sound propagated through the plenum across a frequency range of 20 Hertz (Hz) to 20,000 Hz.

* * * * *